US010368599B1

(12) United States Patent
Bounkhong

(10) Patent No.: US 10,368,599 B1
(45) Date of Patent: Aug. 6, 2019

(54) UNDERGARMENT SUPPORT SYSTEM AND METHOD OF USE

(71) Applicant: Khanthamala Bounkhong, Garland, TX (US)

(72) Inventor: Khanthamala Bounkhong, Garland, TX (US)

( * ) Notice: Subject to any disclaimer, the term of this patent is extended or adjusted under 35 U.S.C. 154(b) by 45 days.

(21) Appl. No.: 15/248,278

(22) Filed: Aug. 26, 2016

Related U.S. Application Data

(60) Provisional application No. 62/209,942, filed on Aug. 26, 2015.

(51) Int. Cl.
*A41F 9/00* (2006.01)
*A41F 17/00* (2006.01)
*A41F 18/00* (2006.01)

(52) U.S. Cl.
CPC ..... *A41F 18/00* (2013.01); *A41F 9/002* (2013.01); *A41F 17/00* (2013.01)

(58) Field of Classification Search
CPC ..... A41F 9/002; A41F 17/00; A41F 18/00
USPC ..... 2/300, 312, 315, 319, 338, 340
See application file for complete search history.

(56) References Cited

U.S. PATENT DOCUMENTS 1,642,105 A * 9/1927 Eastin ..... A41F 9/002 2/302
4,202,343 A * 5/1980 Ichelson ..... A41C 3/0057 450/14
5,214,806 A * 6/1993 Flores ..... A41B 13/00 2/300
6,308,338 B1 * 10/2001 Caldwell ..... A41D 1/062 2/312
6,449,775 B1 * 9/2002 Battaglia ..... A41D 13/02 2/300
6,857,936 B2 * 2/2005 Jones ..... A41F 15/002 450/86
2010/0037371 A1 * 2/2010 Lewis ..... A41F 9/002 2/340

* cited by examiner

*Primary Examiner* — Katherine M Moran
(74) *Attorney, Agent, or Firm* — Eldredge Law Firm, LLC; Richard Eldredge; Beth Felix

(57) ABSTRACT

A suspender system and method of use includes an elongated belt strap that removably engages around the midsection of the user; a first connector secured to a top edge of the elongated belt strap and engaged with a first garment of clothing worn by the user; a second connector secured to a bottom edge of the elongated belt strap and engaged with a second garment of clothing worn by the user.

11 Claims, 3 Drawing Sheets

UNDERGARMENT SUPPORT SYSTEM AND METHOD OF USE

BACKGROUND

1. Field of the Invention

The present invention relates generally to clothing accessory systems, and more specifically, to an undergarment support system for women.

2. Description of Related Art

Undergarment systems are well known in the art and are effective means to provide user support. For example, FIG. 1 depicts a rear view of a common undergarment system 101 having a bra 102 including two straps 103 in communication with a band 104. During use, the bra 102 provides support to the user's breasts by being secured around the user's midsection via the band 104 and straps 103.

One of the problems commonly associated with system 101 is its uncomfortable fit. For example, the band of system 101 may place uncomfortable pressure along areas of the user's midsection and shoulders.

Accordingly, although great strides have been made in the area of undergarment systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
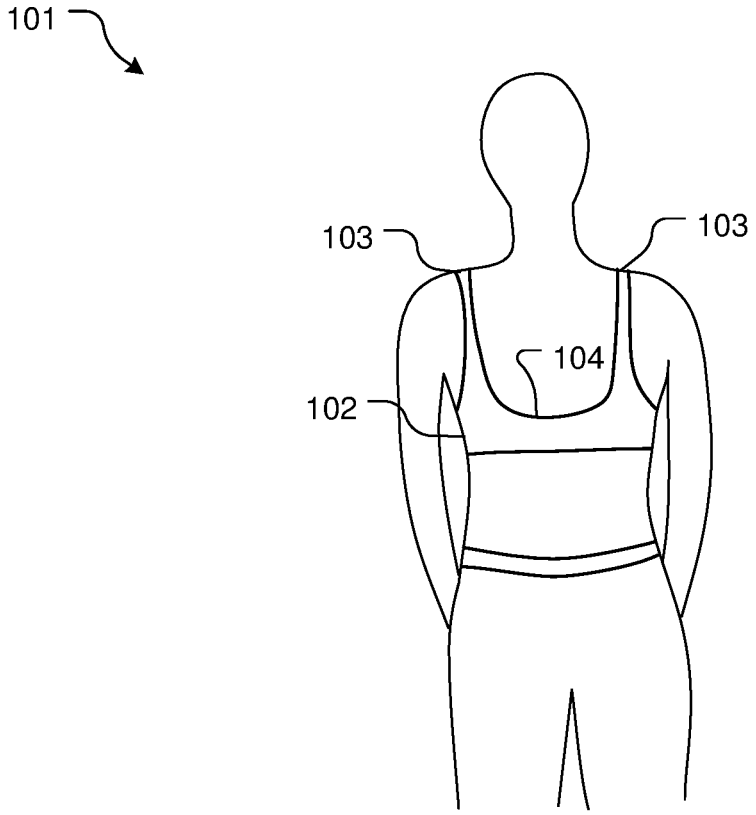
FIG. 1 (Prior Art)
FIG. 1 is a rear view of a common undergarment system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional undergarment systems. Specifically, the present invention reduces pressure along the user's midsection and shoulders. In addition, the present invention provides undergarment support and structure. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
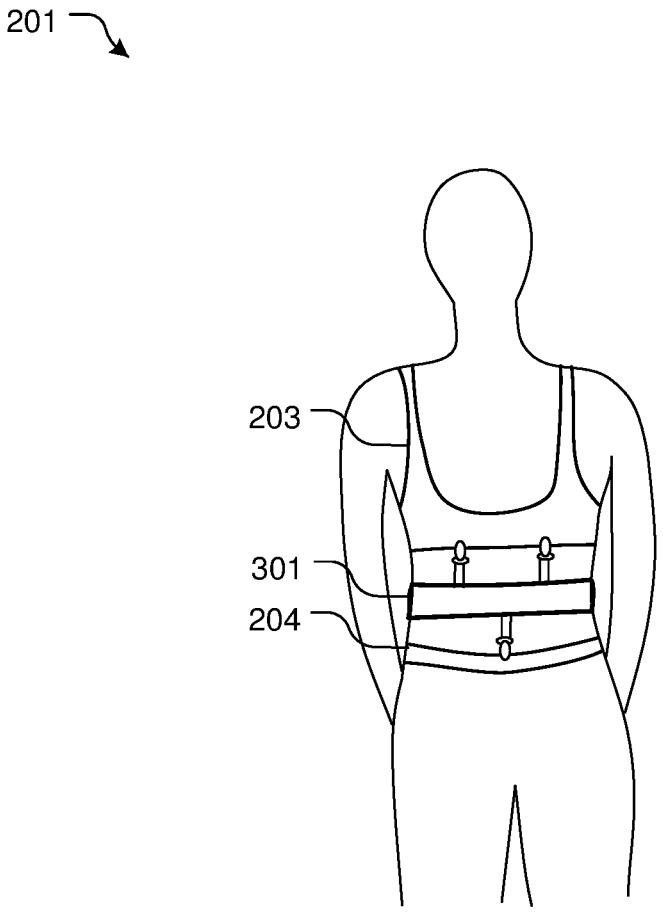
FIG. 2 is a rear view of an undergarment support system in accordance with a preferred embodiment of the present application.

Referring now to the drawings wherein like reference characters identify corresponding or similar elements throughout the several views, FIG. 2 depicts a rear view of an undergarment support system in accordance with a preferred embodiment of the present application. It will be appreciated that system 201 overcomes one or more of the above-listed problems commonly associated with conventional undergarment systems.

Figure 3:
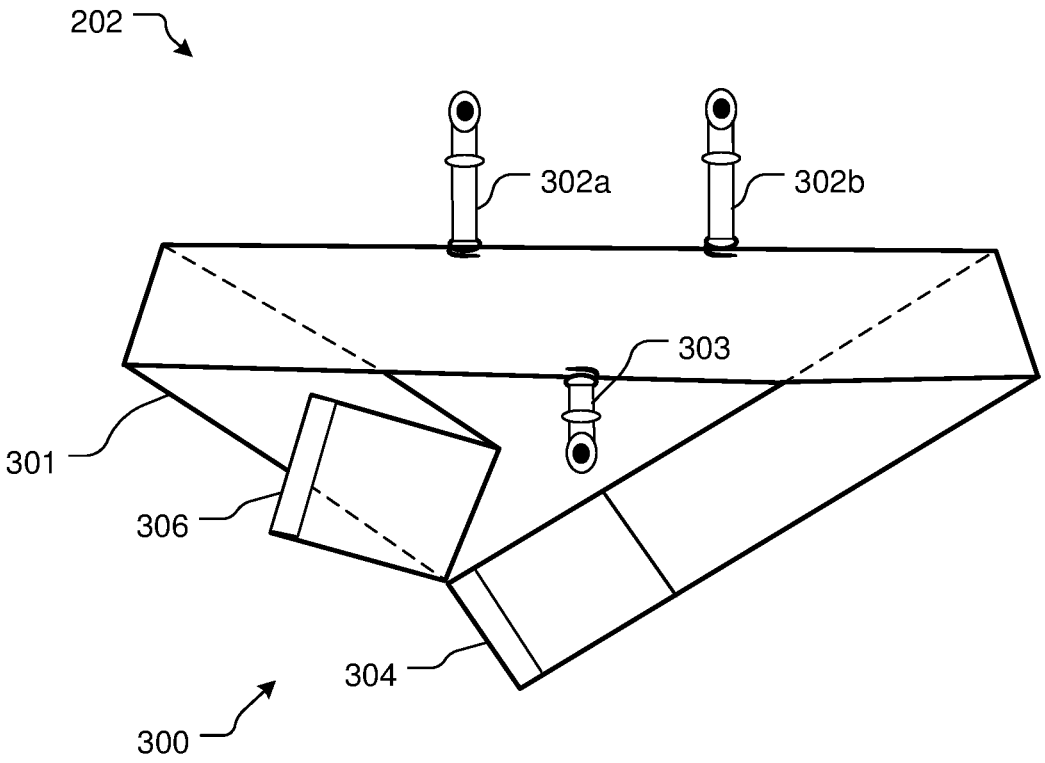
FIG. 3 is a rear view of the undergarment support system from FIG. 2.

In the contemplated embodiment, system 201 includes suspender 202 in communication with the user's bra 203 and lower body clothing (pants, skirt, underwear, etc.) 204. As shown in FIG. 3, the suspender 202 include a belt strap 301 in communication with one or more adjustable top connectors 302*a*, 302*b* and one or more adjustable bottom connectors 303. During use, the belt strap 301 is fastened around the user's waist and secured in position via a locking device 300 having a plurality of loops 304 adapted to engage with a plurality of hooks 306. In the preferred embodiment, the belt strap 301 is selectively adjusted to fit snugly around the mid-section of the user above or around the belly button (not shown).

When used, the top and bottom connectors 302, 303 are connected to the user's bra 203 and lower body garment 204 to relieve pressure along the user's midsection and shoulders provide additional clothing support and structure.

It should be appreciated that one of the unique features believed characteristic of the present application is versatility of system 201 due to the adjustability of the connectors 302*a*, 302*b*, 303 and belt strap 301. It is understood that system 201 can be used in conjunction with most bras and adjusted by the user for comfort.

It is contemplated that the belt strap 301 can be fastened in the front via a hook and loop fastener, hook and eye fasteners, or any other means as well as vary in size and material. In addition, it is contemplated that the connectors 302*a*, 302*b*, 303 can be permanent or removable and can vary in quantity, length, and location along the belt 301. Further, it is contemplated that the connectors 302*a*, 302*b*, 303 can attach to clothing via snaps, hooks, clamps, or any other means.

Figure 4:
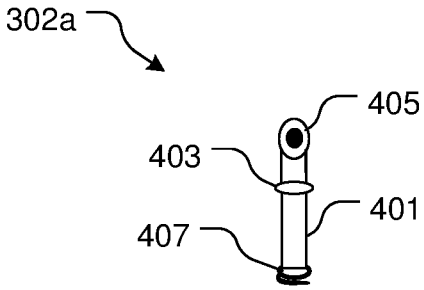
FIG. 4 is a front view of the connector of the system of FIG. 3.

Referring specifically to FIG. 4, a front view of connector 302*a* is shown. It will be appreciated that all connectors discussed herein share one or more of the same features. In the preferred embodiment, the connector 302*a* preferably includes one or more of an elongated strap 401 preferably composed of an elastic material for increase in length during use and having an adjustment device 403, e.g., a buckle, secured thereto for adjusting the overall length of strap 401. At one end of the elongated strap 401 is a fastener 405 configured to removably engage with an article of clothing, e.g., a bra, while at a second end of the elongated strap 401 is a hook 407 and/or similar device configured to removably engage with the belt strap 301 in a more permanent fashion. It will be appreciated that an alternative embodiment could include a plurality of connectors permanently attached to the belt strap in lieu of the preferred embodiment.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A suspender system configured to engage around a midsection of a user, comprising:

an elongated belt strap configured to removably engage around the midsection of the user;

a first connector removably secured to a top edge of the elongated belt strap and connected to a first garment of clothing adapted to be worn by the user, the first garment is a bra, the first connector is adjustable in length;

a second connector removably secured to a bottom edge of the elongated belt strap and connected to a second garment of clothing adapted to be worn by the user, the second garment is a pair of pants, the second connector is adjustable in length;

a third connector removably secured to the top edge of the elongated belt strap and connected to the first garment of clothing;

wherein the second connector is secured at a position between the first connector and the third connector and provides a counter force to the first connector and the third connector;

wherein the first connector and third connector secure to a back portion of the first garment;

wherein the second connector secures to a back portion of the second garment;

wherein the elongated belt strap is secured to the first garment and the second garment via the first, second, and third connectors such that there are no connectors at a front portion of the elongated belt strap;

wherein the elongated belt strap is positioned between the first garment of clothing and second garment of clothing; and wherein the top edge opposes the bottom edge of the elongated belt strap.

2. The system of claim 1, wherein the elongated belt strap is composed of an elastic material.

3. The system of claim 1, further comprising:

a locking device configured to secure a first end of the elongated strap to a second end of the elongated strap.

4. The system of claim 3, wherein the locking device is a hook-loop fastener.

5. The system of claim 1, the first connector comprising:

an elongated strap having a first end and a second end; and a fastener secured to the first end and configured to removably secure to the first garment of clothing.

6. The system of claim 5, wherein the fastener is a snap.

7. The system of claim 5, further comprising:

a hook secured to the second end of the elongated strap.

8. The system of claim 5, further comprising:

an adjustment device secured to the elongated strap and configured to adjust an overall length of the elongated strap.

9. The system of claim 8, wherein the adjustment device is a buckle.

10. The system of claim 5, wherein the elongated strap is composed of an elastic material.

11. A method to secure a first article of clothing to a second article of clothing in a fixed position, comprising:

providing the system of claim 1;

securing the belt strap in a position between the first article of clothing and the second article of clothing; and attaching the first connector to the first article of clothing at a back portion of the first article of clothing;

attaching the third connector to the first article of clothing at a back portion of the first article of clothing; and attaching the second connector to the second article of clothing at a back of the second article of clothing;

wherein the second connector provides a counter force to the first connector and the third connector.

* * * * *